US006336057B1

(12) United States Patent
Obayashi

(10) Patent No.: US 6,336,057 B1
(45) Date of Patent: Jan. 1, 2002

(54) LENS GRINDING APPARATUS

(75) Inventor: Hirokatsu Obayashi, Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 09/301,545

(22) Filed: Apr. 29, 1999

(30) Foreign Application Priority Data

Apr. 30, 1998 (JP) ..... 10-120914

(51) Int. Cl.[7] ..... G06F 19/00; B24B 49/00; B24B 51/00; B24B 7/30

(52) U.S. Cl. ..... 700/164; 451/5; 451/43

(58) Field of Search ..... 700/56, 60, 62, 700/164, 187; 451/5, 43, 255, 256

(56) References Cited

U.S. PATENT DOCUMENTS

| | | | | |
|---|---|---|---|---|
| 4,596,091 A | 6/1986 | Daboudet et al. | ..... | 51/101 LG |
| 5,138,770 A | 8/1992 | Matsuyama | ..... | 33/28 |
| 5,228,242 A | 7/1993 | Matsuyama | ..... | 51/165.74 |
| 5,333,412 A | 8/1994 | Matsuyama | ..... | 51/165.71 |
| 5,347,762 A | 9/1994 | Shibata et al. | ..... | 451/15 |
| 5,803,793 A | 9/1998 | Mizuno et al. | ..... | 451/5 |

FOREIGN PATENT DOCUMENTS

| | | | | |
|---|---|---|---|---|
| EP | 0 857 540 A2 | 8/1998 | ..... | B24B/9/14 |
| EP | 0 890 414 A2 | 1/1999 | ..... | B24B/9/14 |
| JP | 60-238265 | 11/1985 | ..... | B24B/9/14 |
| JP | 3-20603 | 1/1991 | ..... | G01B/5/06 |
| JP | 3-75304 | 11/1991 | ..... | B24B/9/14 |

*Primary Examiner*—Willaim Grant
*Assistant Examiner*—Elliot Frank
(74) *Attorney, Agent, or Firm*—Sughrue Mion, PLLC

(57) ABSTRACT

In an eyeglass lens grinding apparatus for grinding a periphery of a lens, a lens holding system holds a lens while clamping the lens. A data input system inputs shape data of an eyeglass frame to which the lens is fitted, and layout data of the lens with respect to the eyeglass frame. An edge-position-data calculating system obtains edge position data of the lens after layout, on the basis of the data inputted by the data input system. A first measuring system measures an edge position of the lens before processing that is held by the lens holding system, on the basis of the edge position data obtained by the edge-position-data calculating system. A second measuring system measures an edge position of the lens after rough grinding, on the basis of the edge position data. A chamfering-process-data calculating system obtains chamfering process data for processing a corner portion of an edge of the lens after finish processing, on the basis of a result of measurement by the second measuring system. A chamfering process system having a chamfering grinding wheel processes the corner portion of the edge of the lens after the finish processing. A chamfering-process controlling system controls the chamfering process system on the basis of the chamfering process data obtained by the chamfering-process-data calculating system.

20 Claims, 12 Drawing Sheets

LENS GRINDING APPARATUS

BACKGROUND OF THE INVENTION

The present invention relates to an eyeglass lens grinding apparatus for grinding the periphery of an eyeglass lens.

An eyeglass lens grinding apparatus is known which grinds the periphery of an eyeglass lens so that the eyeglass lens fits into an eyeglass frame. In this type of apparatus, a lens to be processed is mounted on one lens rotating shaft via a mounting jig such as a suction cup fixed to a front surface of the lens, while a rear surface of the lens is pressed by a lens holder of another lens rotating shaft, thereby clamping or chucking the lens using the two lens rotating shafts for processing.

In general, a chamfering process is performed subsequently to the peripheral processing so as to remove sharp corner portions from peripheral edges of the lens. Conventionally, this chamfering process is effected manually using a so-called hand grinder having a conical grinding wheel after the lens subjected to a finishing process is detached from the grinding apparatus. However, this operation requires expert skill and is not easy to perform.

Accordingly, the present applicant or assignee proposed an apparatus which makes it possible to perform the chamfering process efficiently with a simple arrangement, as disclosed in Japanese Unexamined Patent Publication No. 254000/1997 and U.S. Pat. No. 5,803,793. The apparatus has a grinding-wheel rotating shaft on which a chamfering grinding wheel and other processing grinding wheels are disposed coaxially. The apparatus controls the relative movement of the grinding-wheel rotating shaft with respect to the lens rotating shaft as well as the axial movement of the grinding-wheel rotating shaft on the basis of chamfering process data, to thereby perform the chamfering process of the lens front and rear surfaces without dismounting the lens subjected to the finishing process from the lens rotating shaft. The chamfering process data is obtained by measuring edge positions on the front and rear surfaces of the lens on the basis of radius vector data on the eyeglass frame and on the basis of the result of that measurement.

However, if the lens to be processed is clamped by the lens rotating shafts, the lens is deflected (deformed) depending on the shape of its front surface side. Generally, if the curve of the lens front surface is gentle with respect to the shape of the lens receiving surface of a mounting jig (in the case of a minus lens), the lens is deformed toward its rear surface side due to a pressing force of the lens holder. In contrast, in a case where the curve of the lens front surface is sharp (in the case of a plus lens), the lens is deformed toward its front surface side. In the case of an unprocessed lens, the stress of this deformation is applied to the overall lens, and is therefore small. If the lens is made smaller by rough grinding, however, since the portion for absorbing the stress is reduced, the deformation is enlarged. The smaller power the lens, that is, smaller the lens thickness becomes, the greater the deformation. The difference of deformation amount before and after rough grinding can reach about 0.2 mm at maximum. For this reason, if the chamfering process is performed on the basis of the lens shape data measured before rough grinding, there are cases where the actual amount of chamfering will differs from an intended amount of chamfering, and the chamfering will not be uniform visually.

SUMMARY OF THE INVENTION

In view of the above-described problems, it is an object of the present invention to provide an apparatus which makes it possible to perform the chamfering process (the processing of edge corner portions) with high accuracy.

The present invention provides the followings:

(1) An eyeglass lens grinding apparatus for grinding a periphery of a lens, comprising:

a lens holding system which holds a lens while clamping the lens;

a data input system which inputs shape data of an eyeglass frame to which the lens is fitted, and layout data of the lens with respect to the eyeglass frame;

an edge-position-data calculating system which, on the basis of the data inputted by the data input system, obtains edge position data of the lens after layout;

a first measuring system which measures an edge position of the lens before processing that is held by the lens holding system, on the basis of the edge position data obtained by the edge-position-data calculating system;

a second measuring system which measures an edge position of the lens after rough grinding, on the basis of the edge position data;

a chamfering-process-data calculating system which obtains chamfering process data for processing a corner portion of an edge of the lens after finish processing, on the basis of a result of measurement by the second measuring system;

a chamfering process system having a chamfering grinding wheel, which processes the corner portion of the edge of the lens after the finish processing; and a chamfering-process controlling system which controls the chamfering process system on the basis of the chamfering process data obtained by the chamfering-process-data calculating system.

(2) The eyeglass lens grinding apparatus according to (1), wherein the edge position data obtained by the edge-position-data calculating system are radius vector data including a radius vector angle and a radius vector length of the lens.

(3) The eyeglass lens grinding apparatus according to (1), further comprising:

a determining system which determines whether or not the lens can be processed on the basis of a result of measurement by the first measuring system; and a notifying system which notifies a result of determination by the determining system.

(4) The eyeglass lens grinding apparatus according to (1), further comprising:

a storage system which stores an inclination angle of a finishing grinding wheel; and an information inputting system which inputs information on a positional change in at least one of a lens front surface and a lens rear surface with respect to the edge position data, wherein the chamfering-process-data calculating system obtains the chamfering process data on the basis of the edge position obtained by the second measuring system, the information on a positional change inputted by the information inputting system, and the inclination angle stored in the storage system.

(5) The eyeglass lens grinding apparatus according to (4), wherein the information on a positional change is information obtained by measuring an edge position different from the edge position measured by the second measuring system on the basis of the edge position data.

(6) The eyeglass lens grinding apparatus according to (5), further comprising:

a position calculating system which calculates, on the basis of the edge position data, another edge position different from the edge position that is measured by the second measuring system on the basis of the edge position data, wherein the second measuring system also measures the edge position obtained by the position calculating system.

(7) The eyeglass lens grinding apparatus according to (1), further comprising:

a beveling process system having a beveling grinding wheel for such a finishing operation as to form a bevel in the lens after rough grinding;

a beveling-process-data calculating system which obtains beveling process data for forming the bevel in the edge of the lens after rough grinding, on the basis of the result of measurement by the second measuring system; and a beveling-process controlling system which controls the beveling process system on the basis of the beveling process data obtained by the bevel-process-data calculating system.

(8) The eyeglass lens grinding apparatus according to (7), further comprising:

a storage system which storing an inclination angle of the beveling grinding wheel; and an information inputting system which inputs information on a positional change in at least one of a lens front surface and a lens rear surface with respect to the edge position data, wherein the beveling-process-data calculating system obtains the beveling process data on the basis of the edge position obtained by the second measuring system, the information on the positional change inputted by the information inputting system, and the inclination angle stored in the storage system.

(9) The eyeglass lens grinding apparatus according to (8), further comprising:

a position calculating system which, on the basis of the edge position data, obtains as the information on a positional change another edge position different from the edge position measured by the second measuring system on the basis of the edge position data, wherein the second measuring system also measures the edge position obtained by the position calculating system.

(10) The eyeglass lens grinding apparatus according to (1), further comprising:

a selecting system which selects whether or not the chamfering process by the chamfering process system is to be performed; and a measurement controlling system which executes both of the measurement by the first measuring system and the measurement by the second measuring system if it is selected by the selecting system that the chamfering process by the chamfering process system is to be performed.

(11) The eyeglass lens grinding apparatus according to (1), further comprising:

a selecting system which selects whether or not the chamfering process by the chamfering process system is to be performed;

a measurement controlling system which executes both of the measurement by the first measuring system and the measurement by the second measuring system if it is selected by the selecting system that the chamfering process by the chamfering process system is to be performed, and which executes only the measurement by the first measuring system if it is selected by the selecting system that the chamfering process by the chamfering process system is not to be performed;

a beveling process system having a beveling grinding wheel for such a finishing operation as to form a bevel in the lens after rough grinding;

a beveling-process-data calculating system which obtains beveling process data for forming the bevel in the edge of the lens after rough grinding; and a beveling-process controlling system which controls the beveling process system on the basis of the beveling process data obtained by the bevel-process-data calculating system, wherein if it is selected by the selecting system that the chamfering process is to be performed, the beveling-process-data calculating system obtains the beveling process data on the basis of a result of measurement by the second measuring system, and if it is selected by the selecting system that the chamfering process is not to be performed, the beveling-process-data calculating system obtains the beveling process data on the basis of a result of measurement by the first measuring system.

(12) The eyeglass lens grinding apparatus according to (1), further comprising:

a rough grinding system having a rough grinding wheel for rough grinding the lens;

a rough-grinding-data calculating system which obtains rough grinding data for rough grinding the lens, on the basis of the edge position data; and a rough-grinding controlling system which controls the rough grinding system on the basis of the rough grinding data obtained by the rough-grinding-data calculating system.

(13) The eyeglass lens grinding apparatus according to (12), further comprising:

a determining system which determines whether or not the lens can be processed on the basis of a result of measurement by the first measuring system; and a notifying system which notifies a result of determination by the determining system, wherein the rough-grinding-data calculating system obtains the rough grinding data if it is determined by the determining system that the lens can be processed; and wherein the rough-grinding controlling system operates the rough grinding system if it is determined by the determining system that the lens can be processed.

(14) The eyeglass lens grinding apparatus according to (12), further comprising:

a beveling process system having a beveling grinding wheel for such a finishing operation as to form a bevel in the lens subjected to rough grinding by the rough grinding system;

a beveling-process-data calculating system which obtains the beveling process data for forming the bevel in the edge of the lens subjected to rough grinding, on the basis of the result of measurement by the second measuring system; and a beveling-process controlling system which controls the beveling process system on the basis of the beveling process data obtained by the bevel-process-data calculating system.

(15) The eyeglass lens grinding apparatus according to (14), further comprising:

a storage system which stores an inclination angle of the beveling grinding wheel; and an information inputting system which inputs information on a positional change in at least one of a lens front surface and a lens rear surface with respect to the edge position data, wherein the beveling-process-data calculating system obtains the beveling process data on the basis of the edge position obtained by the second measuring system, the information on the positional change inputted by the information inputting system, and the inclination angle stored in the storage system.

(16) The eyeglass lens grinding apparatus according to (15), further comprising:

a position calculating system which, on the basis of the edge position data, obtains as the information on the positional change another edge position different from the edge position that is measured by the second measuring system on the basis of the edge position data, wherein the second measuring system also measures the edge position obtained by the position calculating system.

(17) The eyeglass lens grinding apparatus according to (15), wherein the chamfering-process-data calculating system obtains the chamfering process data on the basis of the edge position obtained by the second measuring system, the information on the positional change inputted by the information inputting system, and the inclination angle stored in the storage system.

(18) The eyeglass lens grinding apparatus according to (17), further comprising:

a position calculating system which, on the basis of the edge position data, obtains as the information on the positional change another edge position different from the edge position that is measured by the second measuring system on the basis of the edge position data, wherein the second measuring system also measures the edge position obtained by the position calculating system.

(19) The eyeglass lens grinding apparatus according to (14), further comprising:

a determining system which determines whether or not the lens can be processed on the basis of a result of measurement by the first measuring system; and a notifying system which notifies a result of determination by the determining system, wherein the rough-grinding-data calculating system obtains the rough grinding data if it is determined by the determining system that the lens can be processed; and wherein the rough-grinding controlling system operates the rough grinding system if it is determined by the determining system that the lens can be processed.

(20) The eyeglass lens grinding apparatus according to (12), further comprising:

a selecting system which selects whether or not the chamfering process by the chamfering process system is to be performed;

a measurement controlling system which executes both of the measurement by the first measuring system and the measurement by the second measuring system if it is selected by the selecting system that the chamfering process by the chamfering process system is to be performed, and which executes only the measurement by the first measuring system if it is selected by the selecting system that the chamfering process by the chamfering process system is not to be performed;

a beveling process system having a beveling grinding wheel for such a finishing operation as to form a bevel in the lens subjected to rough grinding by the rough grinding system;

a beveling-process-data calculating system which obtains the beveling process data for forming the bevel in the edge of the lens subjected to rough grinding; and a beveling-process controlling system which controls the beveling process system on the basis of the beveling process data obtained by the bevel-process-data calculating system, wherein if it is selected by the selecting system that the chamfering process is to be performed, the beveling-process-data calculating system obtains the beveling process data on the basis of the result of measurement by the second measuring system, and if it is selected by the selecting system that the chamfering process is not to be performed, the beveling-process-data calculating system obtains the beveling process data on the basis of a result of measurement by the first measuring system.

The present disclosure relates to the subject matter contained in Japanese patent application No. Hei. 10-120914 (filed on Apr. 30, 1998), which is expressly incorporated herein by reference in its entirety.

DESCRIPTION OF THE PREFERRED EMBODIMENT

Figure 1:
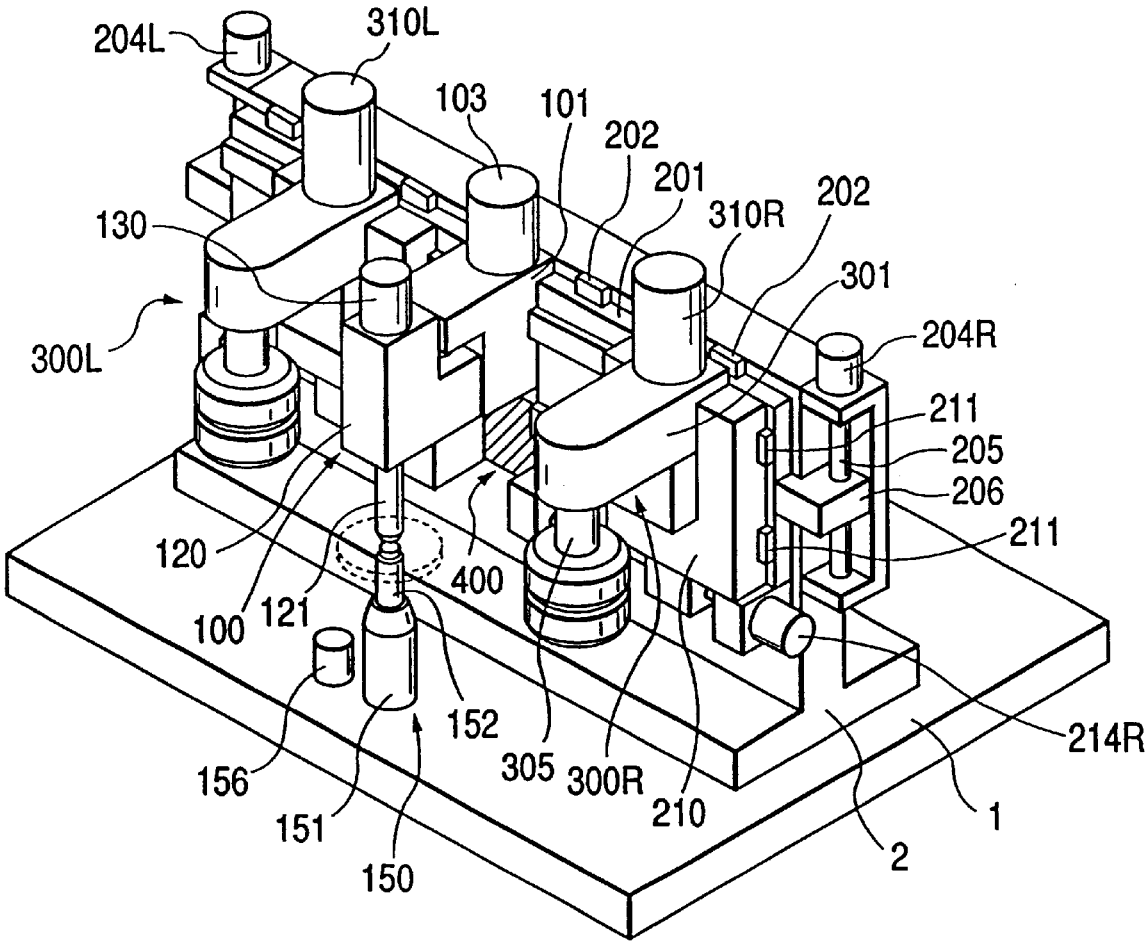
FIG. 1 is a diagram illustrating a processing section of an eyeglass lens grinding apparatus.

Referring now to the accompanying drawings, a description will be given of an embodiment of the present invention. FIG. 1 is a diagram illustrating a processing section of an eyeglass lens grinding apparatus.

A sub-base 2 having a lens chuck upper part 100 and lens grinding parts 300R and 300L is fixed on a main base 1. In addition, a lens thickness measuring section 400 is installed on the farther side in the center of the sub-base 2.

A fixing block 101 which forms a part of the lens chuck upper part 100 is fixed to the center of the sub-base 2, and a DC motor 103 for vertically moving a chuck shaft holder 120 is mounted on top of the fixing block 101. The DC motor 103 rotates a vertically extending feed screw, and this rotation causes the chuck shaft holder 120 to move vertically while being guided by a guide rail fixed to the fixing block 101. A pulse motor 130 for rotating a chuck shaft 121 is fixed on top of the chuck shaft holder 120. A lens holder 124 is attached to a lower end of the chuck shaft 121 (see FIG. 2).

A chuck shaft 152 which forms a part of a lens chuck lower part 150 is rotatably held by a holder 151 which is fixed to the main base 1, and rotation is transmitted thereto by a pulse motor 156. A cup receiver 159 for mounting a cup fixed to a lens to be processed is attached to an upper end of the chuck shaft 152 (see FIG. 2).

Figure 2:
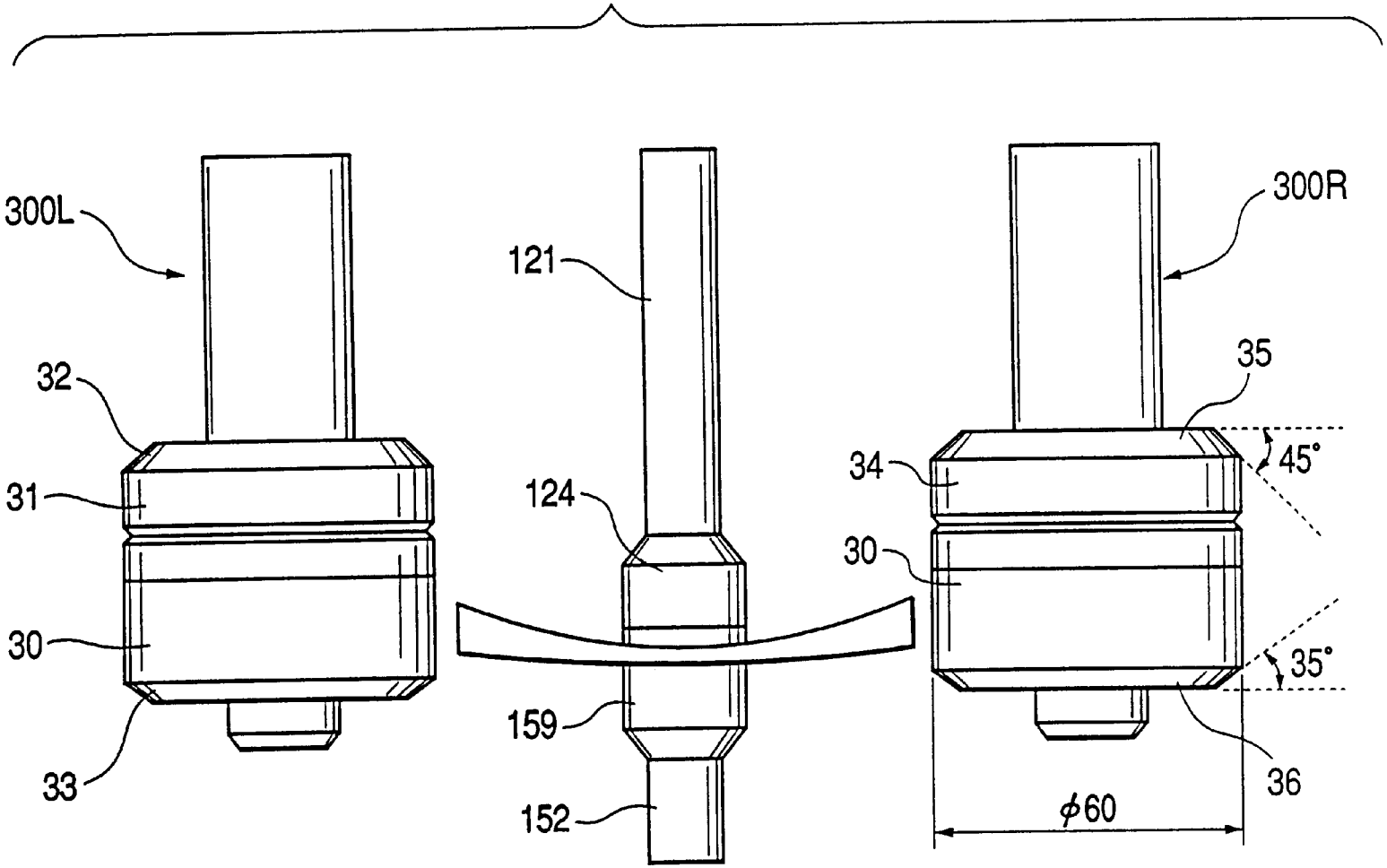
FIG. 2 is a diagram illustrating the arrangement of grinding wheels.

The lens grinding parts 300R and 300L are bilaterally symmetrical, and a housing 305 for rotatably holding therein a rotating shaft having a group of grinding wheels 30 to 33 (or 30 and 34 to 36), such as those shown in FIG. 2, is attached to the front portion of each shaft support base 301. The left and right groups of grinding wheels are respectively rotated by servo motors 310R and 310L which are fixed to the respective shaft support bases 301.

As shown in FIG. 2, the rough grinding wheel 30 and the finishing grinding wheel 31 having a bevel groove are attached to the rotating shaft of the lens grinding part 300L. Further, the conical chamfering grinding wheel 32 for a front surface is coaxially attached to an upper end face of the finishing grinding wheel 31, while the conical chamfering grinding wheel 33 for a rear surface is coaxially attached to a lower end face of the rough grinding wheel 30. The rough grinding wheel 30, the mirror-polishing grinding wheel 34 having a bevel groove, the conical chamfering grinding wheel 35 for a front mirror-polished surface, and the conical chamfering grinding wheel 36 for a rear mirror-polished surface are coaxially attached to the rotating shaft of the lens grinding part 300R. These groups of grinding wheels use grinding wheels whose diameters are relatively small at 60 mm or thereabouts so as to improve the processing accuracy and ensure the durability of the grinding wheels. It should be noted that, in this embodiment, the angles of inclination (the angle of inclination with respect to the horizontal plane) of the chamfering grinding wheels 33 and 36 for the rear surface are set to 35 degrees, while the angles of inclination of the chamfering grinding wheels 32 and 35 for the front surface are set to 45 degrees.

The lens grinding parts 300R and 300L are respectively movable in the vertical direction and the horizontal direction, and their moving mechanisms are arranged as follows: The lens grinding part 300R is fixed to a horizontal slide base 210, and the horizontal slide base 210 is horizontally movable along two guide rails 211 fixed to a vertical slide base 201. The vertical slide base 201 is vertically movable along two guide rails 202 fixed to the front surface of the sub-base 2. A nut block 206 is fixed to the vertical slide base 201, and the vertical slide base 201 moves vertically together with the nut block 206 as a ball screw 205 coupled to a rotating shaft of a pulse motor 204R is rotated. The mechanism for horizontally moving the horizontal slide base 210 is arranged in the same way as the vertically moving mechanism, and is actuated by the rotation of a pulse motor 214R.

The mechanism for moving the lens grinding part 300L is bilaterally symmetrical with the moving mechanism for the lens grinding part 300R, and it is vertically moved by a pulse motor 204L and is horizontally moved by a pulse motor 214L (not shown in FIG. 1).

It should be noted that, for details of the above-described construction, reference may be made on Japanese Unexamined Patent Publication No. 254000/1997 and U.S. Pat. No. 5,803,793 filed by or assigned to the present assignee.

Figure 3:
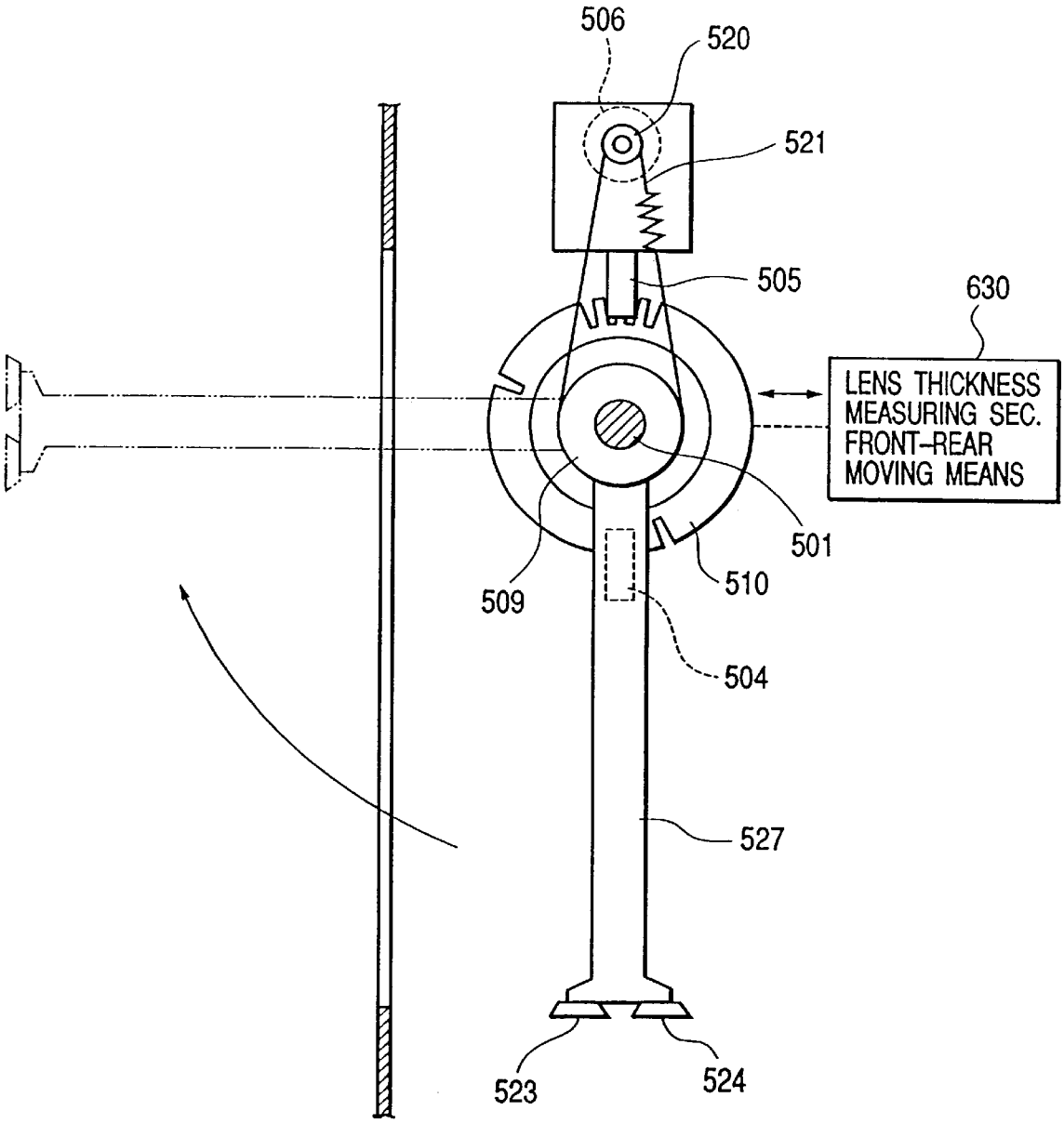
FIG. 3 is a diagram illustrating a lens thickness measuring section.

FIG. 3 illustrates the lens thickness measuring section 400 (FIG. 1). The lens thickness measuring section 400 includes a measuring arm 527 having two feelers 523 and 524, a rotation mechanism such as a DC motor (not shown) for rotating the measuring arm 527, a sensor plate 510 and photo-switches 504 and 505 for detecting the rotation of the measuring arm 527 to thereby allow control of the rotation of the DC motor, a detection mechanism such as a potentiometer 506 for detecting the amount of rotation of the measuring arm 527 to thereby obtain the shapes of the front and rear surfaces of the lens. The configuration of the lens thickness measuring section 400 is basically the same as that disclosed in Japanese Unexamined Patent Publication No. Hei. 3-20603 and U.S. Patent No. 5,333,412 filed by or assigned to the present assignee, which are referred to for details of the lens thickness measuring section 400. A difference from that disclosed in Japanese publication 3-20603 is that the lens thickness measuring section 400 of FIG. 3 is so controlled as to move in front-rear direction (indicated by arrows in FIG. 3) relative to the lens grinding apparatus by a front-rear moving means 630 based on radius vector data. The lens thickness is measured such that the measuring arm 527 is rotated upward from its lower initial position and the feelers 523 and 524 are respectively brought into contact with the front and rear refraction surfaces of the lens. Therefore, it is preferable that the rotary shaft of the measuring arm 527 be equipped with a coil spring or the like which cancels out the downward load of the measuring arm 527.

In addition, the lens thickness (edge thickness) measurement is performed in the following manner. The measuring arm 527 is rotated, that is elevated, so that the feeler 523 is brought into contact with the lens front refraction surface. While keeping the feeler 523 in contact with the lens front refraction surface, the lens is rotated as well as the lens thickness measuring section 400 is controlled to move forward or backward by the front-rear moving means 630, so that the shape of the lens front refraction surface (on the edge of the lens to be formed) is obtained. Then, the shape of the lens rear refraction surface (on the edge of the lens to be formed) is obtained similarly by rotating the lens and by moving the lens thickness measurement section 400 while keeping the feeler 524 in contact with the lens rear refraction surface. The feelers 523 and 524 may be simultaneously brought into contact with the respective front and rear reflection surfaces, to thereby obtain both shapes of the surfaces concurrently.

<Control System>

Figure 4:
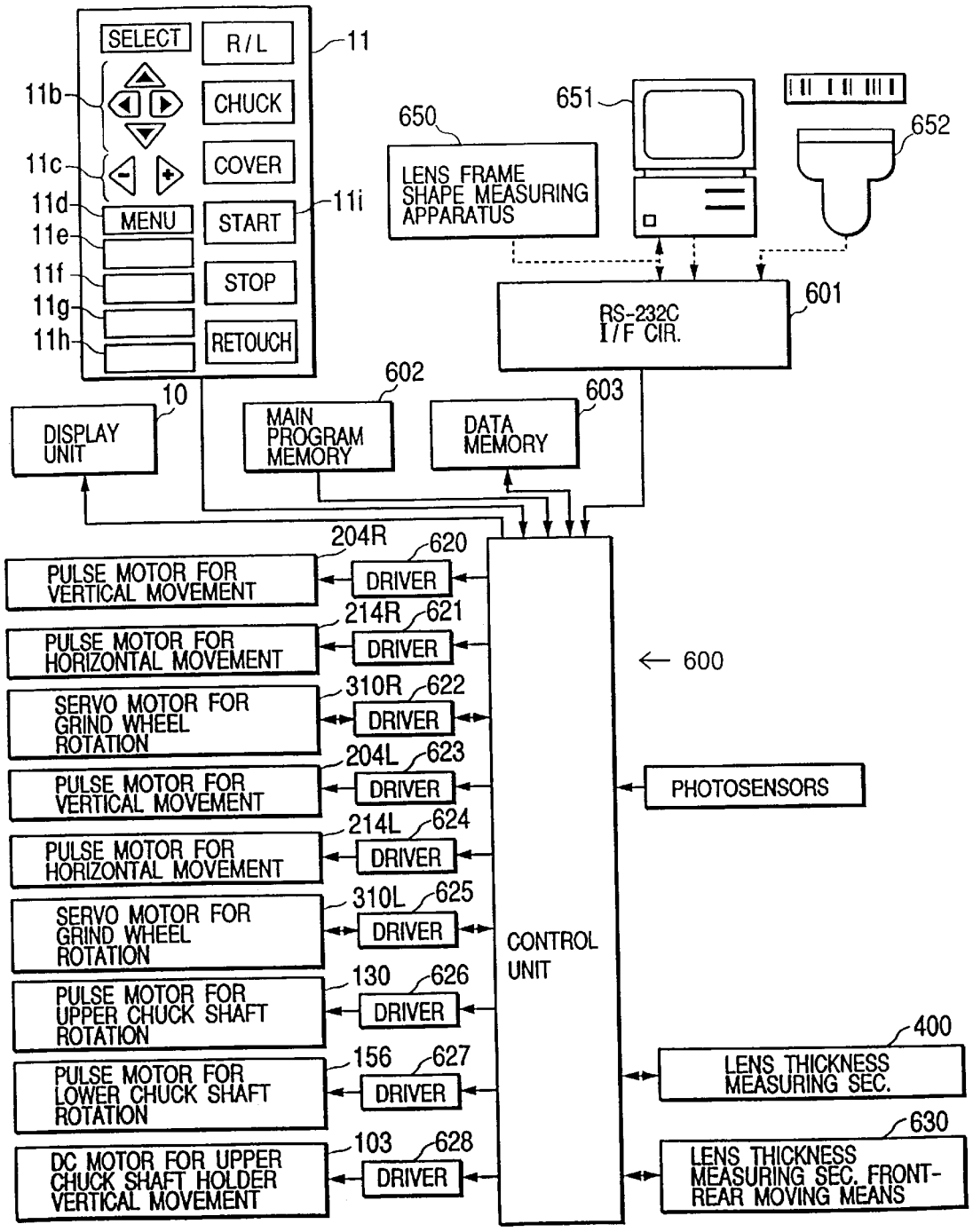
FIG. 4 is a schematic block diagram illustrating a control system of the apparatus.

FIG. 4 is a block diagram showing a general configuration of a control system of the lens grinding apparatus. Reference character 600 denotes a control unit which controls the whole apparatus. The display unit 10, input unit 11 having various operation switches, and photosensors for detecting the initial rotational position of the lens chuck shafts and the initial position of the lens grdingint parts 300R and 300L are connected to the control unit 600. The motors for moving or rotating the respective parts are connected to the control unit 600 via drivers 620–628. The drivers 622 and 625, which are respectively connected to the servo motor 310R for the right lens grinding part 300R and the servo motor 310L for the left lens grinding part 300L, detect the torque of the servo motors 310R and 310L during the processing and feed back the detected torque to the control unit 600. The control unit 600 uses the torque information to control the movement of the lens grinding parts 300R and 300L as well as the rotation of the lens.

Reference numeral 601 denotes an interface circuit which serves to transmit and receive data. An eyeglass frame shape measuring apparatus 650 (see U.S. Pat. No. 5,333,412), a host computer 651 for managing lens processing data, a bar code scanner 652, etc. may be connected to the interface circuit 601. A main program memory 602 stores a program for operating the lens grinding apparatus. A data memory 603 stores data that are supplied through the interface circuit 601, and control unit 600 lens thickness measurement data, and other data.

Figure 5:
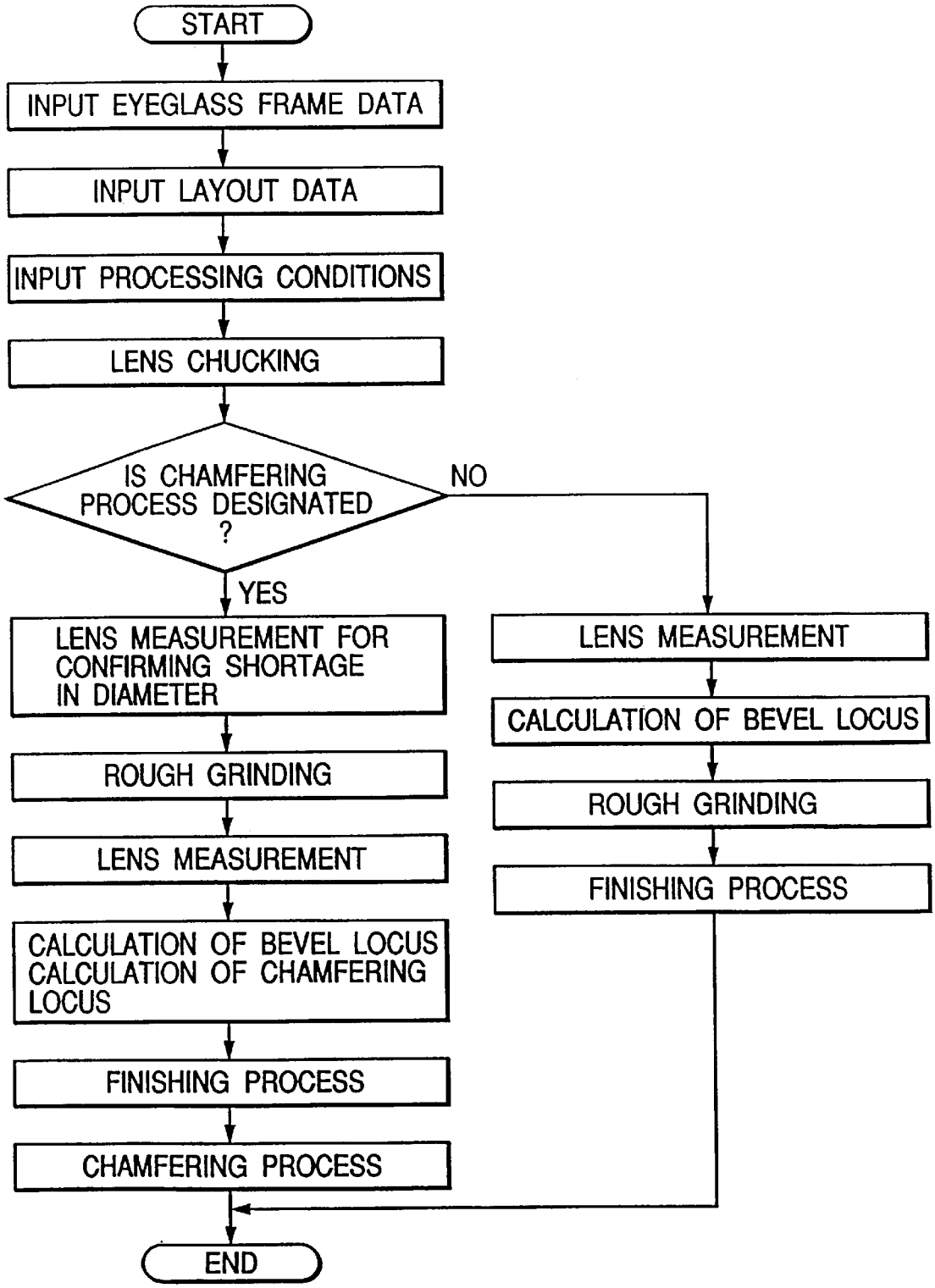
FIG. 5 is a flowchart illustrating a processing operation.

Next, a description will be given of the processing operation (seethe flowchart of FIG. 5). The shape of the eyeglass frame or the template is measured by the lens frame shape measuring apparatus 650, and the measured data is inputted. Since the lens shape based on the eyeglass frame data is displayed on the display unit 10, layout data such as the PD value of the wearer and the optical center height is entered by the switching operation of the input unit 11 with respect to the lens shape. In addition, processing conditions such as the lens material and the processing mode (a beveling process, a plane process, or a mirror-polish process) are entered. When a chamfering process is performed, an instruction for chamfering is entered by a switch 11*g*. In the instruction for chamfering, a chamfering ratio (the edge thickness is divided by a ratio over the entire periphery) as well as the offset amount can be set in advance as parameters. Hereafter, a description will be given of the case where the beveling process and the chamfering process are performed.

The operator attaches the cup to the front surface of the lens to be processed, and places lens on the cup receiver 159 provided on the chuck shaft 152. When the preparation for the process is completed, a START switch 11*i* is pressed to start the operation of the apparatus.

In response to a start signal, the control unit 600 lowers the chuck shaft 121 to chuck the lens to be processed, and then performs lens measurement prior to the rough-grinding process by driving and controlling the front-rear moving means 630 and the lens thickness measuring section 400 in accordance with radius vector data after the layout. If an instruction for chamfering has been made through the switch 11*g*, the lens measurement prior to the rough-grinding process is performed to check whether the lens to be processed has a sufficient diameter (size) or not.

The rough-grinding process is performed if it is confirmed through the lens measurement that the lens has a sufficient diameter (if the lens diameter is insufficient, the display unit 10 indicates so). For the rough-grinding process, the left and right rough grinding wheels 30 are moved vertically to a level where the lens to be processed is held, and then the lens grinding parts 300R and 300L are slid toward the lens. The left and right rough grinding wheels 30 gradually grind the lens from two directions while being rotated. At this time, the amounts of movement of the right and left rough grinding wheels 30 toward the lens are controlled independently of each other on the basis of the rough-grinding process data (which is calculated by leaving a finishing allowance in the normal direction with respect to the radius vector data at the bevel apex position) obtained from the radius vector data.

After the rough-grinding process is completed, the rotation of the grinding wheels is stopped. After the lens grinding parts 300R and 300L are returned to their initial positions, the process proceeds to the lens measurement after the rough-grinding process. The lens measurement after the rough-grinding process is performed to calculate the bevel locus (the bevel path) and the chamfering process locus (the chamfering process path).

Figure 6:
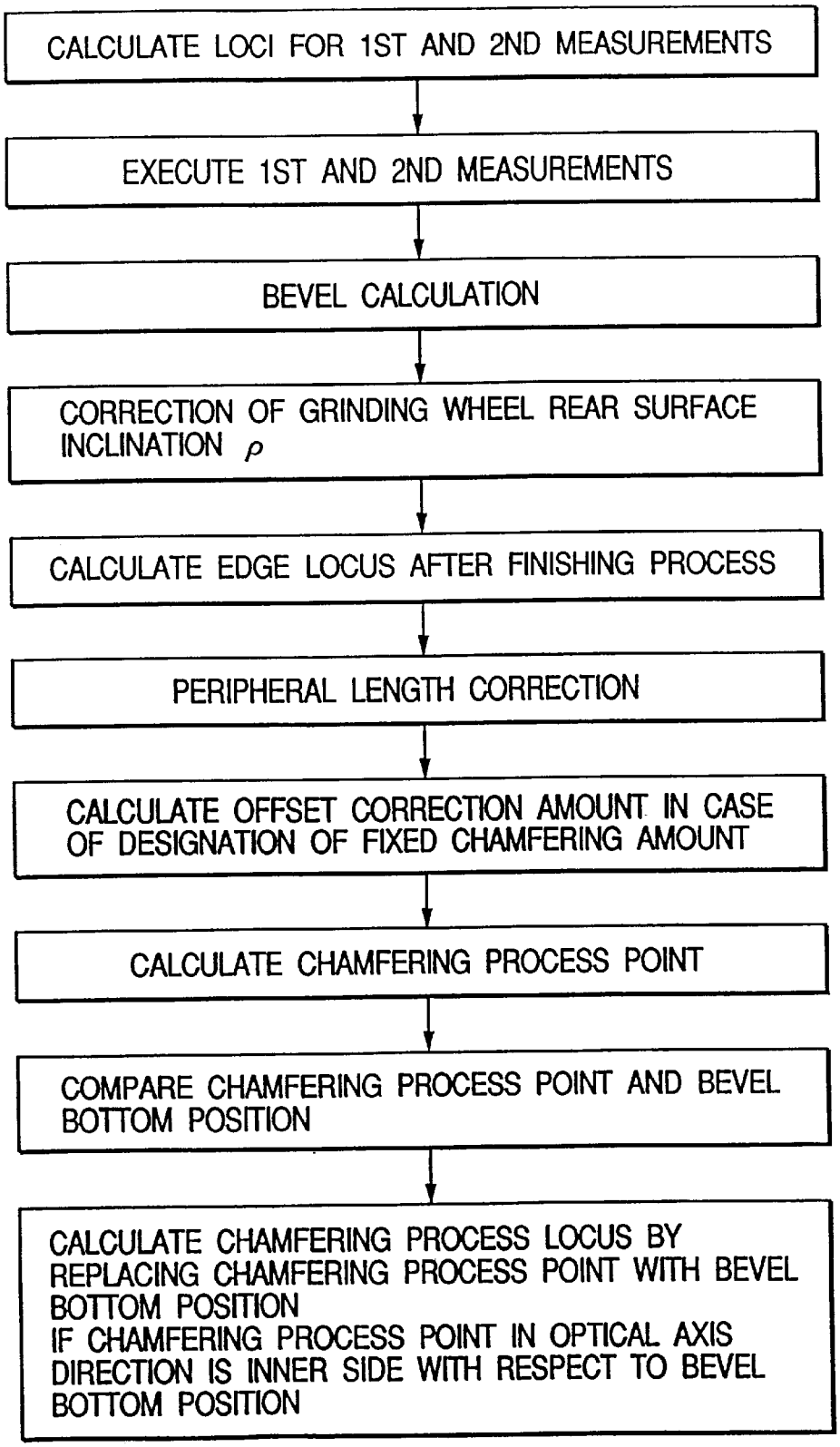
FIG. 6 is a flowchart illustrating a method of calculating a chamfering process locus.

A description will be given of a method of the lens measurement after the rough-grinding process and the calculation of the bevel locus and the chamfering process locus (see the flowchart of FIG. 6).

<Lens Measurement>

In the lens measurement after the rough-grinding process, the shapes of the lens front and rear surfaces are respectively measured twice in accordance with different measurement loci on the basis of the radius vector data after the layout.

In the first measurement of the lens shape, the measurement is performed in accordance with the locus (the path) of the position of the bevel apex (in the specification, this is referred to as the reference shape) to be formed in the lens. This measurement locus (the measurement path) can be obtained from the two-dimensional process data based on the radius vector data after the layout.

The second measurement is performed in accordance with the shape (the locus or path) of the bevel bottom (the portion where the bevel slope and the bevel shoulder intersect each other). This measurement locus in this case can be obtained in the following manner.

Figure 7:
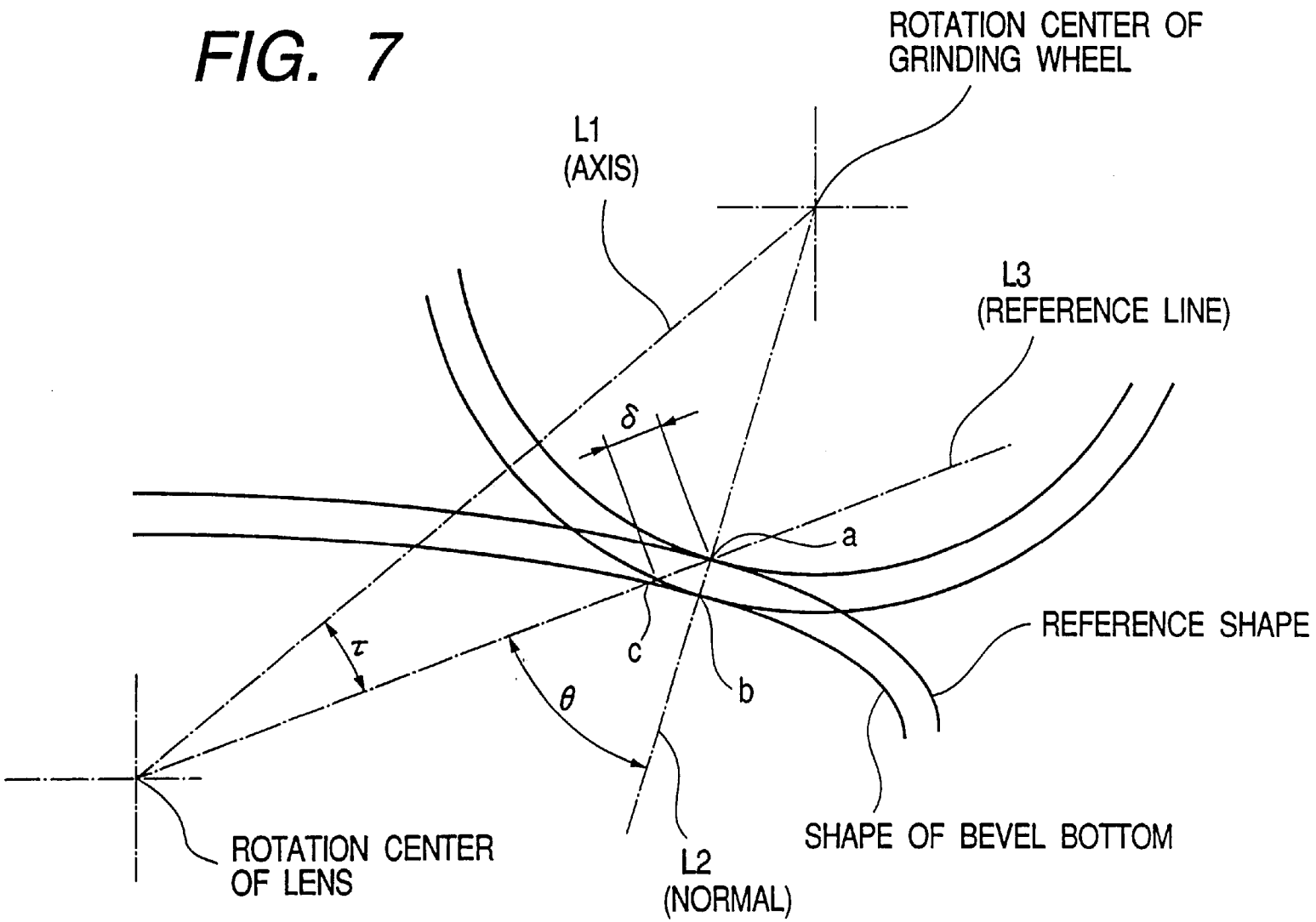
FIG. 7 is a diagram illustrating the calculation of a measurement locus in a second measurement.

As shown in FIG. 7, when a point a at the bevel apex (reference shape) is to be processed, the line connecting the rotation center of the lens and that of the grinding wheel is indicated as an axis L1, the line connecting the process point a and the rotation center of the grinding wheel is indicated as a normal L2, the line connecting the process point a and the rotation center of the lens is indicated as a reference line L3, and the followings are defined:

$\delta$=height of the bevel (the line segment ac) in the direction of the reference line L3, $\theta$=angle between the normal L2 and the reference line L3, $\gamma$=reference height of the bevel (the line segment ab, and already known from the shape of the bevel groove), and $\tau$=angle formed by the normal L2 and the axis L1. The position of the process point a can be obtained by a process correction calculation (basically identical with that described in U.S. Pat. No. 5,347,762) which calculates the axis-to-axis distance between the lens rotation center and the wheel rotation center during a process, from information indicative of the radius vector angle and length of the lens on the basis of the frame shape data and the layout data, and in correspondence with the radius vector angle (the lens rotation angle during a process). When the position of the process point a is once obtained, $\theta$ and $\tau$ are known.

Assuming that the angle formed by the line segments ab and bc of $\Delta$abc of FIG. 7 is approximately rectangular, the following is held:

$$\delta=\gamma/\cos\theta$$

By subtracting the bevel height δ from the reference shape in the direction of the reference line L3, the distance of the bevel bottom at the process point a can be obtained. When the distance is calculated at each places in correspondence with the radius vector angle, the measurement locus in the second measurement can be obtained.

<Calculation of Bevel Locus>

When the lens shape is once measured, it is possible to obtain three-dimensional bevel curve locus data (three-dimensional bevel curve path data) which are to be applied to the lens edge, on the basis of information indicative of the lens shape and in accordance with a predetermined program. As for this calculation, there have been proposed several methods such as that a curve is determined from front and rear surface curves, that the edge thickness is divided, and that the two methods are combinedly performed (the movement or the selection may be performed in response to an input operation by the optician). For details of this calculation, reference may be made on commonly assigned U.S. Pat. No. 5,347,762, etc.

<Calculation of Chamfering Process Locus>

The calculation of the chamfering process locus is made by determining the edge position locus (the edge position path) after the finishing process and on the basis of this edge position locus. In a case where chamfering is provided for the lens rear refraction surface and the lens front refraction surface, respectively, the edge position loci are determined at the respective surfaces, but a description will be given herein by citing the lens rear surface as an example.

The edge locus (the edge path) after the beveling (finishing) process is calculated from the edge position information and the bevel curve locus data, which are obtained through two lens shape measurements. In this calculation, an offset of the edge position is corrected with respect to the inclination angle of the finishing grinding wheel so as to form an edge shoulder.

Figure 8:
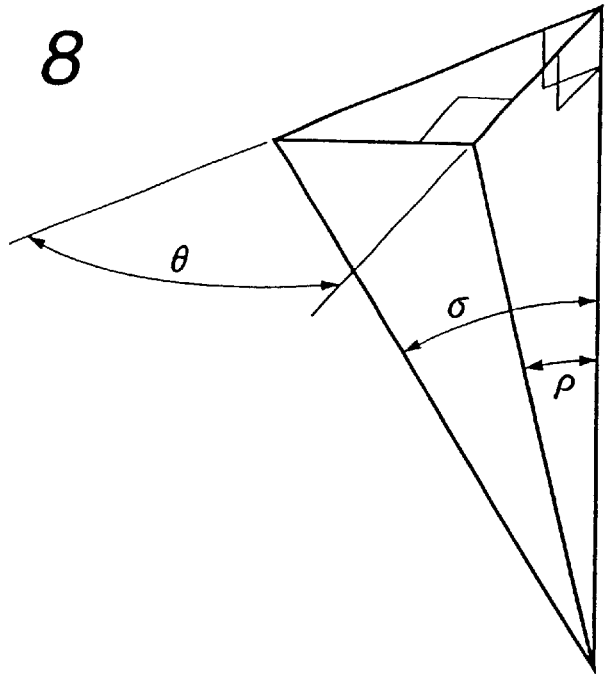
FIG. 8 is a diagram illustrating the calculation of a correction angle $\sigma$ of a rear surface inclination angle $\rho$ in a finishing grinding wheel.
Figure 14:
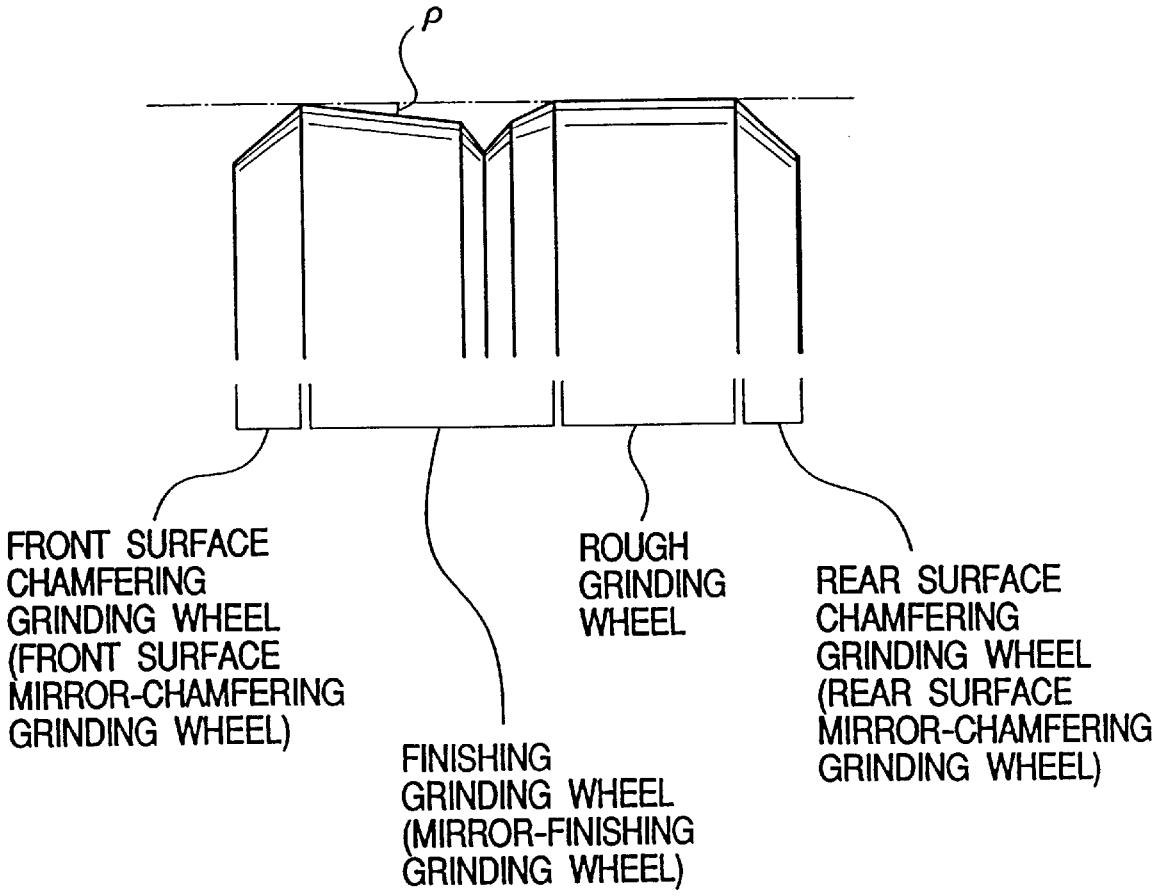
FIG. 14 is a side view for explaining a rear surface inclination angle $\rho$ of a finishing grinding wheel.

First, a correction angle for the lens rear surface inclination with respect to the rear surface inclination angle ρ (this value is previously known and stored in the main program memory 602) of the finishing grinding wheel (as shown in FIG. 14) is calculated. When a lens is processed at the rear surface inclination angle ρ of the finishing grinding wheel, the inclination angle of the lens bevel shoulder in the direction of the normal L2 becomes as it is to the inclination angle ρ. In order to obtain the edge locus in the direction of the reference line L3, however, a correction angle must be considered for the section shape in the direction of the reference line L3. From FIG. 8, the correction angle σ for this purpose is obtained as:

$$\sigma = \arctan(\tan\rho/\cos\theta)$$

This correction angle σ is obtained for each place in accordance with the radius vector angle.

Figure 9:
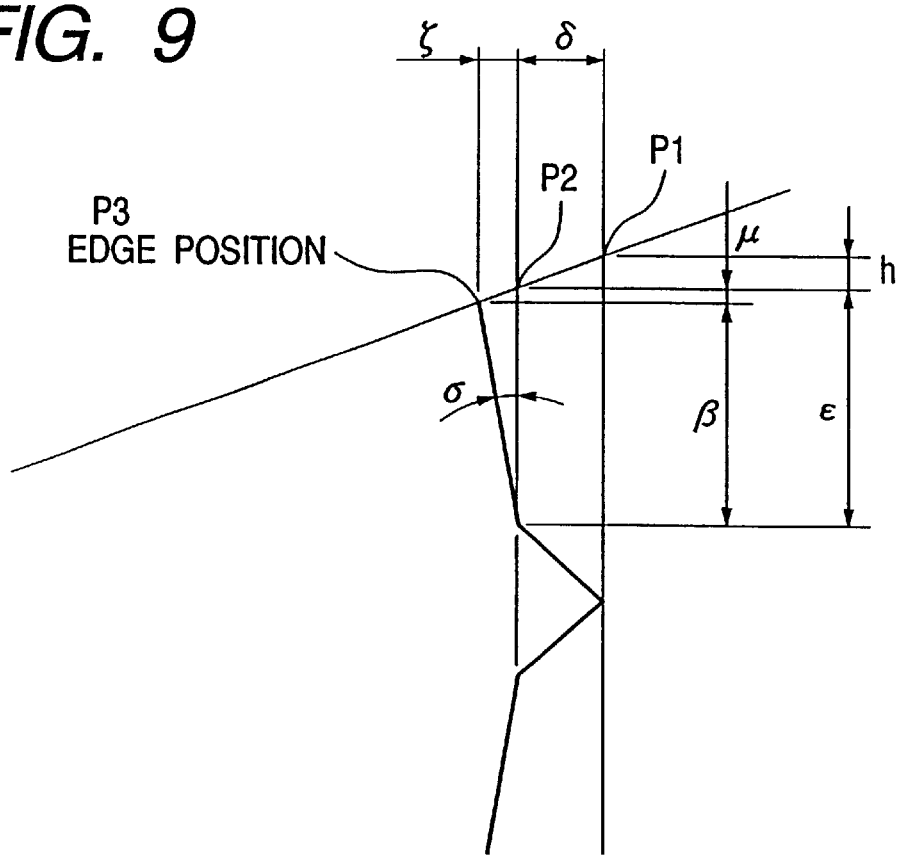
FIG. 9 is a diagram illustrating the calculation of an edge position P3 after a finishing process.

Next, as shown in FIG. 9, the section shape in the direction of the reference line L3 is considered in accordance with the correction angle σ of the rear surface inclination, and the edge position P3 of the lens rear surface after the beveling process is obtained. In FIG. 9, P1 denotes the edge position obtained in the first measurement of the lens edge position, and P2 denotes the edge position obtained in the second measurement. In this case, h of FIG. 9 is obtained from the result of the measurement of the lens edge position, and δ from the result of the second measurement (the measurement result at the bevel bottom) and the bevel calculation result. When the rear surface is approximately considered as a straight line, therefore, a correction amount $\mu$ in the optical axis direction of the lens, and a correction amount ξ in the radial direction of the lens are expressed as follows:

[Ex. 1]

When the correction amounts are obtained for each place in accordance with the radius vector angle, information of the edge locus on the side of the rear surface after the beveling process is obtained.

Figure 10A:
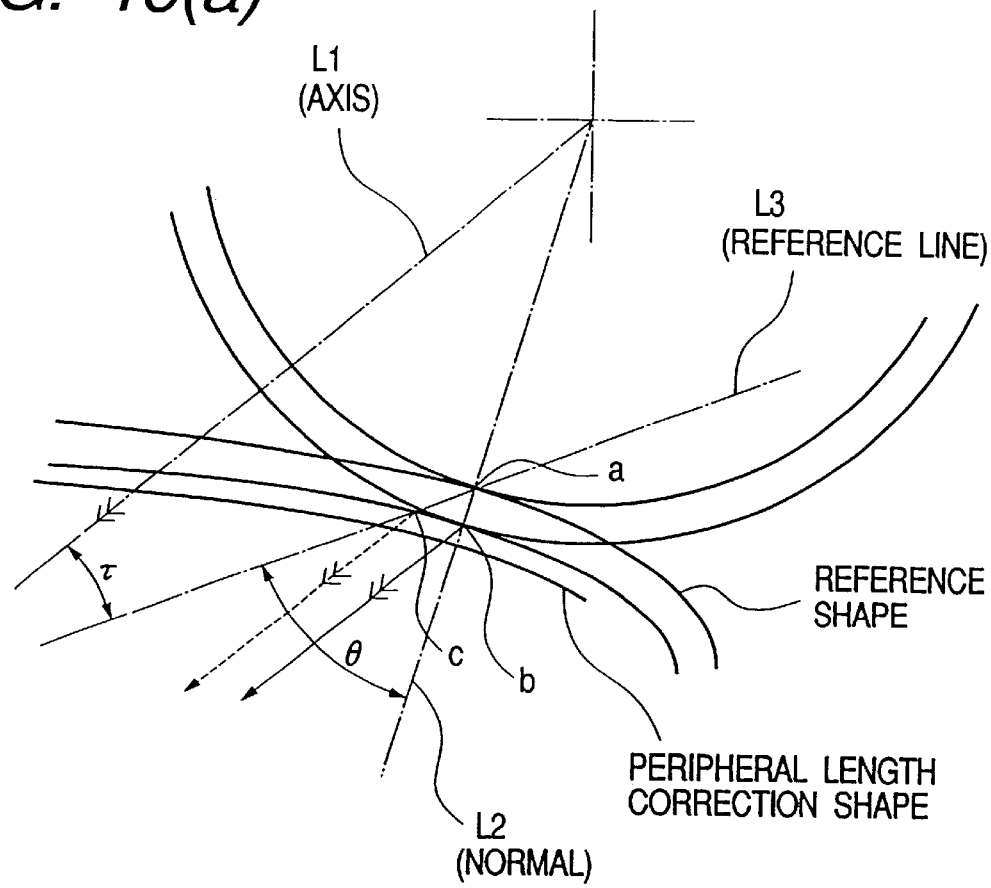
FIGS. 10(*a*) and 10(*b*) are diagrams illustrating a change in the configuration due to peripheral length correction and the calculation of a correction amount w in the direction of a reference line L3.
Figure 10B:
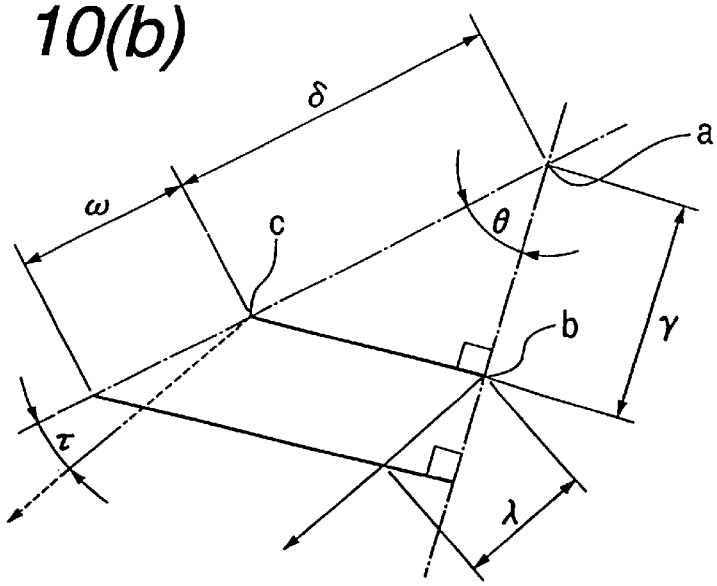

As described in U.S. Pat. No. 5,347,762, when a lens which has undergone a beveling process is to be mounted to an eyeglass frame, it is preferable to correct the position of the bevel apex so that the curve locus (the curve path) of the eyeglass frame substantially coincides in peripheral length with the bevel curve locus. In the correction (hereinafter, referred to as peripheral length correction), the peripheral length of the bevel curve locus is approximately obtained by calculating distances among the bevel curve locus data obtained in the bevel calculation on the basis of the data, and summing the distances. The correction amount can be obtained from the thus obtained peripheral length, and the peripheral length of the eyeglass frame shape which is similarly obtained from the radius vector information of the frame shape. The calculation of the edge locus after the beveling process in the case where the peripheral length correction is performed will be described. In the above, all the correction calculations are performed on the reference line L3. The shape change due to the peripheral length correction occurs in the direction of the axis L1 (see FIG. 10(*a*)). Consideration will be made with substituting the shape change due to the peripheral length correction for that in the reference line L3. It is assumed that, as shown in FIG. 10(*b*), a point b of the bevel bottom before the peripheral length correction is corrected in the direction of the axis L1 by a peripheral length correction amount λ, and a point c also is corrected in the direction of the axis L1 at the point b. In this case, a correction amount ω in the direction of the reference line L3 can be approximately obtained by:

[Ex. 2]

Figure 11:
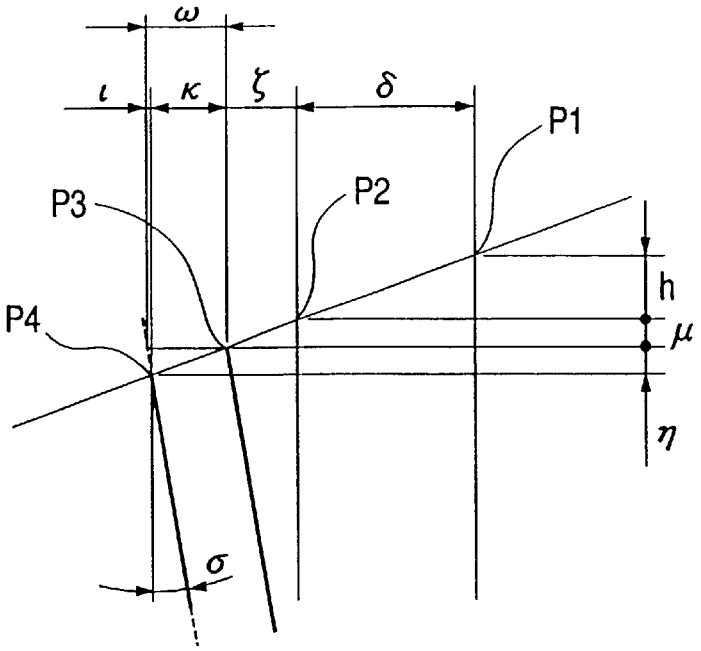
FIG. 11 is a diagram illustrating the calculation of the edge position after a finishing process in the case where a peripheral length correction is performed.

In order to obtain the edge locus after the beveling process due to the peripheral length correction, the section shape shown in FIG. 11 and in the direction of the reference line L3 will be considered in the same manner as described above. Assuming that the edge position P3 is shifted to P4 as a result of the peripheral length correction, when the correction amount in the radial direction of the lens is indicated by κ and that in the optical axis direction of the lens is indicated by η, these correction amounts are as follows:

[Ex. 3]

In the case where the peripheral length correction is performed, therefore, the correction amounts of the edge position after the final beveling process are expressed as follows:

[Ex. 4]

When the correction amounts are obtained for each place in accordance with the radius vector angle, information of the edge locus on the side of the lens rear surface in the case where the peripheral length correction is performed is obtained.

Next, the calculation of the chamfering process locus which is performed during the chamfering process in order to visually uniformalize the chamfer shape will be described with reference to FIG. 12. Even when the edge locus is obtained as described above and a fixed chamfering amount from the edge end (P4) in the bevel direction is designated (an offset of a fixed amount is applied), the length of the chamfered slope after chamfering (hereinafter, the length is referred to as chamfering width) is changed by influence of the rear surface curve, with the result that the chamfering is visually recognized not to be uniformly performed. In order to visually uniformalize the chamfering width in the case where a fixed chamfering amount is designated, therefore, the chamfering process locus is obtained so that the length of the slope after chamfering is uniform irrespective of the radius vector angle.

Figure 12:
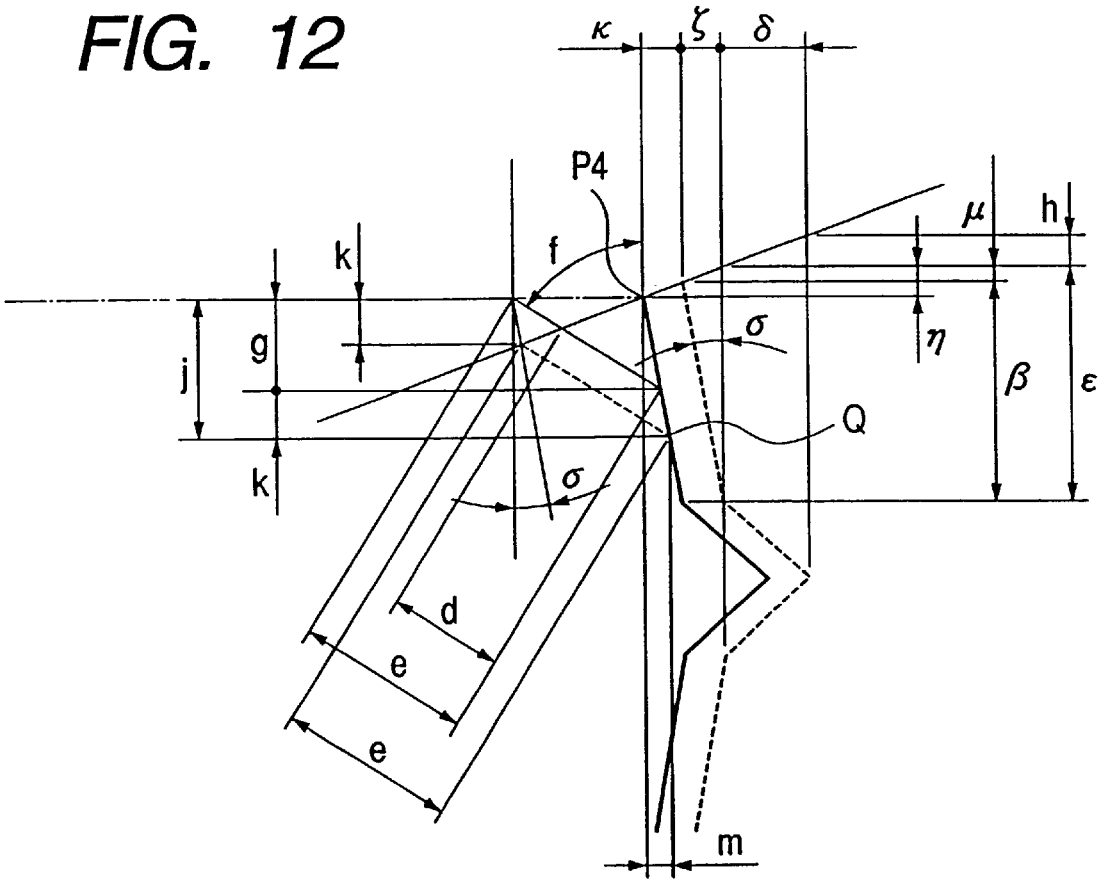
FIG. 12 is a diagram illustrating the calculation of the chamfering process locus.

In FIG. 12, g denotes an offset component of the chamfering amount, j denotes an offset amount after correction, f denotes a correction angle of the inclination angle F of the chamfering grinding wheel (a previously known value, and, in the embodiment, 35 degrees) in the direction of the reference line L3, and e denotes a chamfering width in the case where the rear surface of the lens is flat. The chamfering width becomes equal in size to the chamfering width d because of the rear surface curve. In a method of uniformalizing the chamfering width, an offset correction amount k is obtained so as to attain the chamfering width which is equal to that in the case where the rear surface of the lens is flat. In order to perform the method, the correction angle f is first obtained. In the same manner as that of obtaining the correction angle σ in FIG. 8, the correction angle is obtained by:

$$f=\arctan(\tan F/\cos\theta).$$

From the figure, the offset correction amount k is obtained as follows:

[Ex. 5]

This method is based on the approximation expression. When the offset component g is largely increased, therefore, the error is increased. From the view point of visual uniformalization, when the offset component g is greater than 1 mm, it is preferable to obtain the offset correction amount k while setting g to be 1 (g=1). When the correction angle σ is sufficiently small, the offset correction amount may be expressed as follows:

[Ex. 6]

(in the correction on the side of the front surface of the lens, particularly, the influence is very small).

From the above, it will be seen that the position of a chamfering process point Q in the optical axis direction with respect to the edge position P4 shown in FIG. 12 can be obtained by an addition of g+k. For the position of the chamfering process point Q in the radial direction of the lens with respect to the edge position P4, a correction amount m can be obtained by:

$$m=j\cdot\tan\sigma.$$

The thus obtained position of the chamfering process point Q is information which is obtained without considering the position of the bevel bottom. In the case of a beveling process, the chamfering process must be performed so as not to interfere with the bevel. To comply with this, a process is performed in which the position of the bevel bottom is obtained, the position is compared with the chamfering process point, and, if the chamfering process point Q in the optical axis direction is in the inner side with respect to the position of the bevel bottom, the bevel bottom position is substituted for the chamfering process point.

Figure 13:
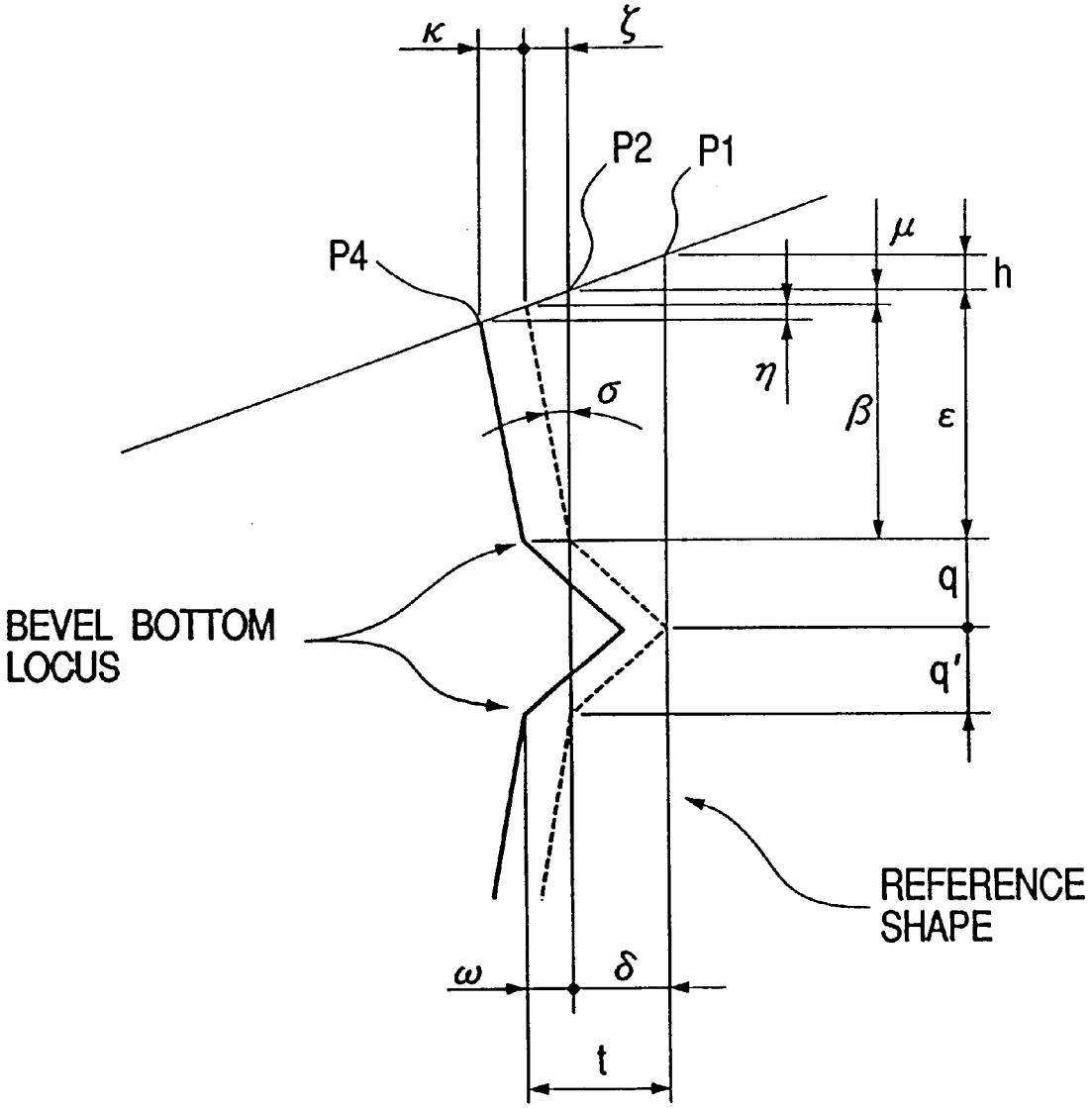
FIG. 13 is a diagram illustrating the calculation of a value of a bevel bottom position in a radial direction of the lens.

As shown in FIG. 13, the value of the bevel bottom position in the radial direction of the lens can be obtained by subtracting t=δ+ω from the reference shape (this is equal to that obtained by subtracting co from the locus of the second measurement). The value of the bevel bottom position in the optical axis direction of the lens is obtained by using q and q' obtained by splitting the bevel apex. The q and q' are obtained from the shape of the bevel groove of the finishing grinding wheel.

In this way, the chamfering process point Q and the position of the bevel bottom are obtained for the whole periphery in accordance with the radius vector angle, and the chamfering process locus in which the chamfering process does not interfere with the bevel can be obtained. The chamfering process locus on the side of the front surface of the lens can be obtained in the same method. Also in a plane process in which a beveling process is not performed, the chamfering process locus can be obtained in a basically same concept.

When the bevel locus data and the chamfering process locus data are obtained as described above, the bevel process and the chamfering process are automatically performed consecutively. The control unit 600 performs the bevel process by controlling the height of the bevel groove of the finishing grinding wheel 31 and its movement in the direction toward the lens on the basis of the bevelling process data stored in the data memory 603. Since the beveling process data used in the process has been obtained from the result of lens measurement after the rough-grinding process, the bevel is formed at an accurate position.

When the beveling process is completed, the operation proceeds to the chamfering process. The control unit 600 performs the chamfering process by controlling the movement of the chamfering grinding wheel 32 for the front surface and the chamfering grinding wheel 33 for the rear surface in the vertical direction and in the direction toward the lens on the basis of the chamfering process data stored in the data memory 603. Since the chamfering process data has been determined from the edge position obtained by measuring the shape of the actual lens which has been subjected to the rough-grinding process so that the deformation is enlarged, chamfering can be performed for both the front surface and the rear surface with high accuracy.

Although in the above description the first measurement and the second measurement are performed twice over the entire periphery in the measurement of the lens edge, the lens data may be used instead if the lens data is available from another source.

As described above, since the chamfering locus (processing data of an edge corner portion) is obtained on the basis of the lens measurement data obtained after the rough-grinding process, the edge corner portion can be processed with higher accuracy without being affected by the shape of the lens and its power. In addition, processing can be performed such that the bevel position can be accurately secured.

$$\beta\tan\sigma=\mu\delta/h\quad \beta=\epsilon-\mu \qquad \text{[Ex. 1]}$$

Optical axis direction $$\mu=\frac{\varepsilon\tan\sigma}{\frac{\delta}{h}+\tan\sigma}$$

Radial direction $$\zeta=\mu\delta/h$$

[Ex. 2]

$$\omega = \frac{\gamma + \lambda\cos(\theta - \tau)}{\cos\theta} - \delta$$

[Ex. 3]

$$\kappa = \frac{\omega\delta}{h\tan\sigma + \delta}$$

$$\eta = k^{1/5}$$

[Ex. 4]

Radial direction $$\zeta + \kappa = \mu\frac{\delta}{h} + \frac{\omega\delta}{h\tan\sigma + \delta} = \frac{\varepsilon\tan\sigma + \omega}{\frac{h}{\delta}\tan\sigma + 1}$$

Optical axis direction $$\mu + \eta = \frac{\varepsilon\tan\sigma}{\frac{\delta}{h} + \tan\sigma} + \kappa\frac{h}{\delta} = \frac{\varepsilon\tan\sigma + \omega}{\frac{\delta}{h} + \tan\sigma}$$

[Ex. 5]

$$k = \frac{g(\tan f - \tan\sigma)}{\tan\sigma + \frac{\delta}{h}}$$

[Ex. 6]

$$k = \frac{gh}{\delta}\tan f$$

What is claimed is:

1. An eyeglass lens grinding apparatus for grinding a periphery of a lens, comprising:

a lens holding system which holds a lens while clamping the lens;

a data input system which inputs shape data of an eyeglass frame to which the lens is fitted, and layout data of the lens with respect to the eyeglass frame;

an edge-position-data calculating system which, on the basis of the data inputted by the data input system, obtains edge position data of the lens after layout;

a first measuring system which measures an edge position of the lens before processing that is held by the lens holding system, on the basis of the edge position data obtained by the edge-position-data calculating system;

a second measuring system which measures an edge position of the lens after rough grinding, on the basis of the edge position data;

a chamfering-process-data calculating system which obtains chamfering process data for processing a corner portion of an edge of the lens after finish processing, on the basis of a result of measurement by the second measuring system;

a chamfering process system having a chamfering grinding wheel, which processes the corner portion of the edge of the lens after the finish processing; and a chamfering-process controlling system which controls the chamfering process system on the basis of the chamfering process data obtained by the chamfering-process-data calculating system.

2. The eyeglass lens grinding apparatus according to claim 1, wherein the edge position data obtained by the edge-position-data calculating system are radius vector data including a radius vector angle and a radius vector length of the lens.

3. The eyeglass lens grinding apparatus according to claim 1, further comprising:

a determining system which determines whether or not the lens can be processed on the basis of a result of measurement by the first measuring system; and a notifying system which notifies a result of determination by the determining system.

4. The eyeglass lens grinding apparatus according to claim 1, further comprising:

a storage system which stores an inclination angle of a finishing grinding wheel; and an information inputting system which inputs information on a positional change in at least one of a lens front surface and a lens rear surface with respect to the edge position data, wherein the chamfering-process-data calculating system obtains the chamfering process data on the basis of the edge position obtained by the second measuring system, the information on a positional change inputted by the information inputting system, and the inclination angle stored in the storage system.

5. The eyeglass lens grinding apparatus according to claim 4, wherein the information on a positional change is information obtained by measuring an edge position different from the edge position measured by the second measuring system on the basis of the edge position data.

6. The eyeglass lens grinding apparatus according to claim 5, further comprising:

a position calculating system which calculates, on the basis of the edge position data, another edge position different from the edge position that is measured by the second measuring system on the basis of the edge position data, wherein the second measuring system also measures the edge position obtained by the position calculating system.

7. The eyeglass lens grinding apparatus according to claim 1, further comprising:

a beveling process system having a beveling grinding wheel for such a finishing operation as to form a bevel in the lens after rough grinding;

a beveling-process-data calculating system which obtains beveling process data for forming the bevel in the edge of the lens after rough grinding, on the basis of the result of measurement by the second measuring system; and a beveling-process controlling system which controls the beveling process system on the basis of the beveling process data obtained by the bevel-process-data calculating system.

8. The eyeglass lens grinding apparatus according to claim 7, further comprising:

a storage system which storing an inclination angle of the beveling grinding wheel; and an information inputting system which inputs information on a positional change in at least one of a lens front surface and a lens rear surface with respect to the edge position data, wherein the beveling-process-data calculating system obtains the beveling process data on the basis of the edge position obtained by the second measuring system, the information on the positional change inputted by the information inputting system, and the inclination angle stored in the storage system.

9. The eyeglass lens grinding apparatus according to claim 8, further comprising:

a position calculating system which, on the basis of the edge position data, obtains as the information on a positional change another edge position different from the edge position measured by the second measuring system on the basis of the edge position data, wherein the second measuring system also measures the edge position obtained by the position calculating system.

10. The eyeglass lens grinding apparatus according to claim 1, further comprising:

a selecting system which selects whether or not the chamfering process by the chamfering process system is to be performed; and a measurement controlling system which executes both of the measurement by the first measuring system and the measurement by the second measuring system if it is selected by the selecting system that the chamfering process by the chamfering process system is to be performed.

11. The eyeglass lens grinding apparatus according to claim 1, further comprising:

a selecting system which selects whether or not the chamfering process by the chamfering process system is to be performed;

a measurement controlling system which executes both of the measurement by the first measuring system and the measurement by the second measuring system if it is selected by the selecting system that the chamfering process by the chamfering process system is to be performed, and which executes only the measurement by the first measuring system if it is selected by the selecting system that the chamfering process by the chamfering process system is not to be performed;

a beveling process system having a beveling grinding wheel for such a finishing operation as to form a bevel in the lens after rough grinding;

a beveling-process-data calculating system which obtains beveling process data for forming the bevel in the edge of the lens after rough grinding; and a beveling-process controlling system which controls the beveling process system on the basis of the beveling process data obtained by the bevel-process-data calculating system, wherein if it is selected by the selecting system that the chamfering process is to be performed, the beveling-process-data calculating system obtains the beveling process data on the basis of a result of measurement by the second measuring system, and if it is selected by the selecting system that the chamfering process is not to be performed, the beveling-process-data calculating system obtains the beveling process data on the basis of a result of measurement by the first measuring system.

12. The eyeglass lens grinding apparatus according to claim 1, further comprising:

a rough grinding system having a rough grinding wheel for rough grinding the lens;

a rough-grinding-data calculating system which obtains rough grinding data for rough grinding the lens, on the basis of the edge position data; and a rough-grinding controlling system which controls the rough grinding system on the basis of the rough grinding data obtained by the rough-grinding-data calculating system.

13. The eyeglass lens grinding apparatus according to claim 12, further comprising:

a determining system which determines whether or not the lens can be processed on the basis of a result of measurement by the first measuring system; and a notifying system which notifies a result of determination by the determining system, wherein the rough-grinding -data calculating system obtains the rough grinding data if it is determined by the determining system that the lens can be processed; and wherein the rough-grinding controlling system operates the rough grinding system if it is determined by the determining system that the lens can be processed.

14. The eyeglass lens grinding apparatus according to claim 12, further comprising:

a beveling process system having a beveling grinding wheel for such a finishing operation as to form a bevel in the lens subjected to rough grinding by the rough grinding system;

a beveling-process-data calculating system which obtains the beveling process data for forming the bevel in the edge of the lens subjected to rough grinding, on the basis of the result of measurement by the second measuring system; and a beveling-process controlling system which controls the beveling process system on the basis of the beveling process data obtained by the bevel-process-data calculating system.

15. The eyeglass lens grinding apparatus according to claim 14, further comprising:

a storage system which stores an inclination angle of the beveling grinding wheel; and an information inputting system which inputs information on a positional change in at least one of a lens front surface and a lens rear surface with respect to the edge position data, wherein the beveling-process-data calculating system obtains the beveling process data on the basis of the edge position obtained by the second measuring system, the information on the positional change inputted by the information inputting system, and the inclination angle stored in the storage system.

16. The eyeglass lens grinding apparatus according to claim 15, further comprising:

a position calculating system which, on the basis of the edge position data, obtains as the information on the positional change another edge position different from the edge position that is measured by the second measuring system on the basis of the edge position data, wherein the second measuring system also measures the edge position obtained by the position calculating system.

17. The eyeglass lens grinding apparatus according to claim 15, wherein the chamfering-process-data calculating system obtains the chamfering process data on the basis of the edge position obtained by the second measuring system, the information on the positional change inputted by the information inputting system, and the inclination angle stored in the storage system.

18. The eyeglass lens grinding apparatus according to claim 17, further comprising:

a position calculating system which , on the basis of the edge position data, obtains as the information on the positional change another edge position different from the edge position that is measured by the second measuring system on the basis of the edge position data, wherein the second measuring system also measures the edge position obtained by the position calculating system.

19. The eyeglass lens grinding apparatus according to claim 14, further comprising:

a determining system which determines whether or not the lens can be processed on the basis of a result of measurement by the first measuring system; and a notifying system which notifies a result of determination by the determining system, wherein the rough-grinding-data calculating system obtains the rough grinding data if it is determined by the determining system that the lens can be processed; and wherein the rough-grinding controlling system operates the rough grinding system if it is determined by the determining system that the lens can be processed.

20. The eyeglass lens grinding apparatus according to claim 12, further comprising:

a selecting system which selects whether or not the chamfering process by the chamfering process system is to be performed;

a measurement controlling system which executes both of the measurement by the first measuring system and the measurement by the second measuring system if it is selected by the selecting system that the chamfering process by the chamfering process system is to be performed, and which executes only the measurement by the first measuring system if it is selected by the selecting system that the chamfering process by the chamfering process system is not to be performed;

a beveling process system having a beveling grinding wheel for such a finishing operation as to form a bevel in the lens subjected to rough grinding by the rough grinding system;

a beveling-process-data calculating system which obtains the beveling process data for forming the bevel in the edge of the lens subjected to rough grinding; and a beveling-process controlling system which controls the beveling process system on the basis of the beveling process data obtained by the bevel-process-data calculating system, wherein if it is selected by the selecting system that the chamfering process is to be performed, the beveling-process-data calculating system obtains the beveling process data on the basis of the result of measurement by the second measuring system, and if it is selected by the selecting system that the chamfering process is not to be performed, the beveling-process-data calculating system obtains the beveling process data on the basis of a result of measurement by the first measuring system.

* * * * *